US006272780B1

(12) United States Patent
Satamian

(10) Patent No.: US 6,272,780 B1
(45) Date of Patent: Aug. 14, 2001

(54) LABEL WITH APPLIED HANDLE

(75) Inventor: Hratch Satamian, Chatsworth, CA (US)

(73) Assignee: Pharmaceutic Litho & Label Company, Inc., Chatsworth, CA (US)

( * ) Notice: Subject to any disclaimer, the term of this patent is extended or adjusted under 35 U.S.C. 154(b) by 0 days.

(21) Appl. No.: 09/277,385

(22) Filed: Mar. 25, 1999

Related U.S. Application Data

(60) Provisional application No. 60/080,257, filed on Apr. 1, 1998.

(51) Int. Cl.[7] ..... G09F 3/10

(52) U.S. Cl. ..... 40/638; 40/617; 40/310; 215/399; 283/81; 248/311.3

(58) Field of Search ..... 40/310, 638, 630, 40/617; 215/399; 283/81, 900; 248/311.3, 205.3, 683

(56) References Cited

U.S. PATENT DOCUMENTS

| | | | | |
|---|---|---|---|---|
| Re. 36,258 | * | 7/1999 | Coward et al. | 215/399 |
| 4,013,187 | * | 3/1977 | Betka | 215/399 |
| 5,135,125 | * | 8/1992 | Andel et al. | 215/399 |
| 5,738,381 | * | 4/1998 | Treleaven et al. | 283/81 |
| 5,823,503 | * | 10/1998 | Wasserman | 248/683 |
| 5,829,788 | * | 11/1998 | Jackson | 283/81 |
| 5,829,789 | * | 11/1998 | Treleaven et al. | 283/81 |
| 5,878,901 | * | 2/2000 | Groskopf | 215/399 |
| 5,958,536 | * | 2/2000 | Gelsinger | 283/81 |
| 6,027,780 | * | 2/2000 | Treleaven et al. | 283/81 |

* cited by examiner

*Primary Examiner*—Anthony Knight
*Assistant Examiner*—James M Hewitt
(74) *Attorney, Agent, or Firm*—Colin P. Abrahams

(57) ABSTRACT

A label with an applied handle having a liner material, a label and a handle. The label has an upper surface and lower surface and is secured to the liner by an adhesive layer on its lower surface. The adhesive layer allows the label to be peeled off the liner with the adhesive remaining on the lower surface of the label. The handle is affixed to the upper surface of the label, and includes an elongate strip and a hanger. The elongate strip has an upper and a lower surface extending continuously across an entire length of the label. The lower surface of the elongate strip is firmly secured to the upper surface of the label by a strong bonding material and a hanger portion integrally connected to the elongate strip and extending therefrom. The hanger portion has an upper surface and a lower surface with no adhesive thereon, and is pivotable relative to the elongate strip so as to be movable between a first position wherein the hanger portion is adjacent the label portion, and a second position wherein the hanger portion is pivoted through substantially 180 degrees from the first position.

24 Claims, 4 Drawing Sheets

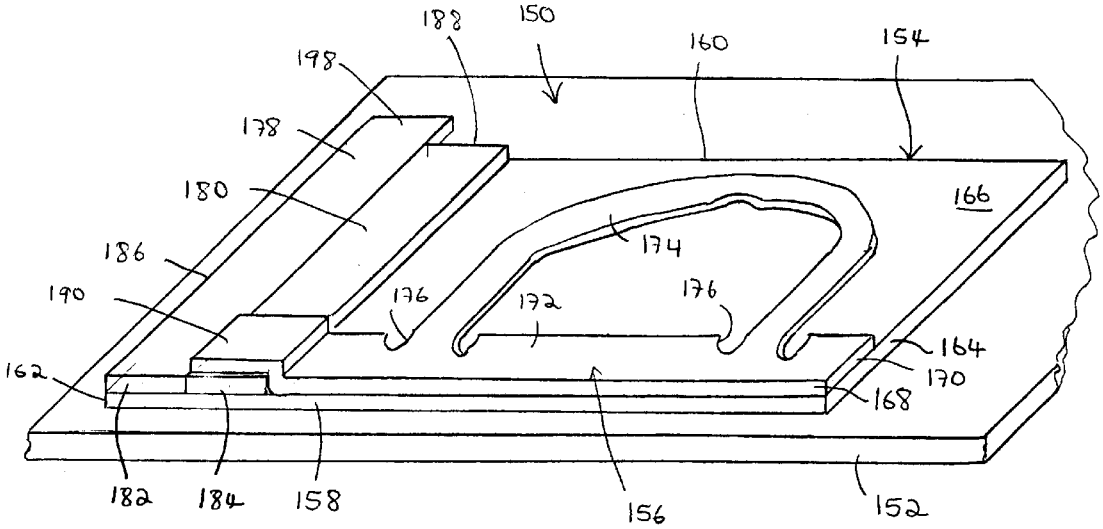
FIG. 8
FIG. 9
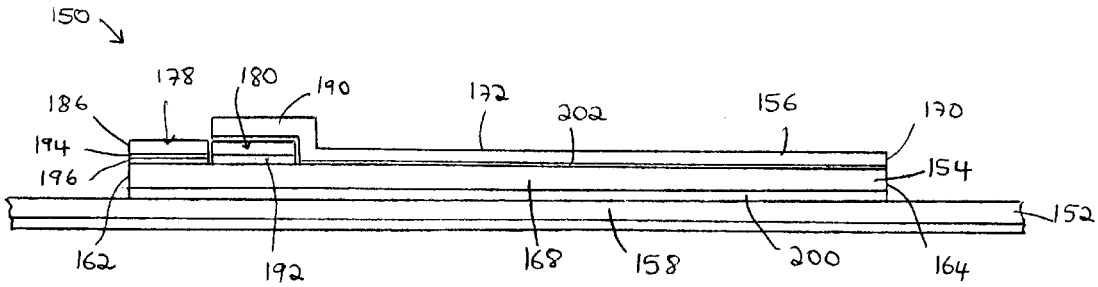

LABEL WITH APPLIED HANDLE

CROSS REFERENCE TO RELATED APPLICATIONS

This application claims the benefit of U.S. Provisional Application No. 60/080,257 filed Apr. 1, 1998.

FIELD AND BACKGROUND OF THE INVENTION

This invention relates to labels having applied handles. The invention also relates to labels including thereon a secondary or peel-off label and/or an information booklet.

The label of the invention is of particular use when applied to a bottle, for use in a hospital or health care type setting, and where the bottle is to be hung in an inverted position. With the bottle suspended in an inverted position, and with appropriate conduits and piping extending from the mouth of the bottle to, for example, a patient, fluids are able to flow from the bottle, at predetermined flow rates, and thus provide a steady supply of essential nutrients, medicines and the like to the patient.

There are a substantial number of labels described in the patent literature which incorporate handles, thereby enabling the bottle to which the label is attached to hang in an inverted position. In one form, such a label including a handle would comprise a number of fused and integrated layers, wherein the handle is cut out from one or more of these layers, and adhesives which would otherwise hold the layers together are inactivated or deadened using resins or other appropriate substances. In many examples of the prior art, the handle is actually cut from the fused laminate body of the label, and thereafter peeled away from the label when required as a hangar to suspend the bottle in its operative position.

U.S. Pat. No. 5,135,125 (Andel) discloses a hanging label wherein a hanging ring is formed as an integral part of the label for suspending the bottle from an intravenous stand. The label is built up from at least one layer of film, a layer of printing ink, and a layer of adhesive. The handle is created from the label by die cut lines that penetrate at least the one layer of film in the label. A release coating is applied between the appropriate layers to permit the handle to be peeled away from the remaining portion of the label. Andel, therefore, describes a typical example of the art of hanging labels, wherein the label is made up of several layers having different structures and purposes, where at least some of these layers are die cut in the shape of the handle, with the application of a suitable release coating so that the dye cut handle can be easily peeled away from the remainder of the label.

U.S. Pat. No. 5,490,658 (Coward) shows another form of a label hanger for intravenous bottles. In this patent, there is described a label hanger assembly having a label sheet with at least one hang strip cut therein. The hang strips are integral with the label sheet. An adhesive coating is applied to one side of the label sheet in a pattern so that the hang strip does not have adhesive on any side thereof. The label sheet adheres to an IV bottle and the hang strips are pulled out of the label sheet so the bottle can be hung in an upside down position from a stand. In the main embodiment, Coward shows a label hanger with two hang tags which, when removed from the label, are on diametrically opposed sides of the bottle. However, several other embodiments, including a foldout ring, are also shown in this patent.

International Application WO 97/42089 (Pharmagraphics) discloses another form of hanger label. In this publication, there is shown a label including a base label and a hanger having two legs. Each leg terminates in a foot portion, which is secured to a connector strip on the base label. Pharmagraphics discloses labels which may include three or more legs, with each leg having its own (or sharing) a foot portion by means of which it is secured to the base label. Each foot portion is a discreet and separate part, disconnected from other foot portions by the presence of gaps therebetween.

European Patent Application 0 356 574 (Schreiner) describes yet another form of a self adhesive label with a suspension flap. The label is mounted on a carrier film, and carries conventional imprints. A suspension flap is secured to the surface of the label. Both the label and the suspension flap are of a polyester material. The suspension flap covers a middle portion of the label, but is transparent to allow print therebelow to be easily read. The suspension flap comprises a strap or handle portion, as well as a region which is adhered to the label to form the secure connection. The securing region is relatively large, and covers a substantial middle portion of the label.

U.S. Pat. No. 5,829,788 (Jackson) shows another form of hanging label, in this case one with a ring which is folded on the label and unfolds as the ring is pulled away from the label.

SUMMARY OF THE INVENTION

In one aspect, the present invention is for a label with an applied handle, wherein the label may comprise a conventional format label of desired size and shape and a specially formatted and configured handle portion, cut separately, which is applied to the label. Preferably, the handle would be configured so that its size and shape correspond to the extent possible with the label to which it is to be applied, and, particularly, so that it can be firmly secured to the label over as wide a practical area as is possible in order to ensure that it remains fixed to the label during use.

The invention provides for a very strong adhesive bond and contact between the base section of the handle and the label, the bond being sufficiently firm so as to prevent separation between the label and the handle portion to ensure that any bottle is firmly held in a continuous manner, when suspended, from the handle.

In another form of the invention, the entire handle portion may comprise a base, such as a liner, and the adhesive is applied only where it is required, while the remaining portions thereof has no adhesive. The adhesive would provide bonding between the base and the label, and no adhesive would be present along those portions of the hanger section to enable the hanger section.

According to one aspect of the invention, there is provided a label with applied handle comprising: a liner material; a label having an upper and lower surface located on the liner, the label being secured to the liner by an adhesive layer on its lower surface, the adhesive layer being such that the label can be peeled off the liner with the adhesive remaining on the lower surface of the label; and a handle partially affixed to the upper surface of the label, the handle comprising an elongate strip having an upper and a lower surface and extending continuously across an entire length of the label, the lower surface of the elongate strip being firmly secured to the upper surface of the label by a strong bonding material, and a hanger portion integrally connected to the elongate strip and extending therefrom, the hanger portion having an upper surface and a lower surface with no adhesive thereon, the hanger portion being pivotable relative to the elongate strip so as to be movable between a first position wherein the hanger portion is adjacent the label portion, and a second position wherein the hanger portion is pivoted through substantially 180 degrees from the first position.

Preferably, the elongate strip comprises a series of scores or perforations to form a line of weakness along at least a part of its width. Multiple lines of weakness may be provided, each line of weakness being substantially transverse to the length of the elongate strip. In this specification, a perforation is series of holes separated from each other, the holes extending through the elongate strip. A score is a continuous or broken cut extending through a part of the thickness of the elongate strip only. The line of weakness may be comprised of either perforations or score(s).

The hanger preferably comprises a semi-circular ring portion and a pair of depending leg portions, each leg portion having one end thereof connected to the elongate strip. An adhesive border at the transition between the elongate strip and the leg portion may be provided, the adhesive border having on one side thereof of the lower surface of the handle adhesive whereby the elongate strip is applied to the label, and on the other side thereof on the lower surface of the handle an absence of adhesive, the adhesive border providing a pivot about which the hanger moves between the first and second position.

To provide the label with applied handle, or any part thereof, with additional strength and to preserve the legibility of any information printed thereon, there may be located on the label a layer which is specifically designed to resist tears, nicks, scratches or other damage which may result from normal use of the label. Preferably, the resistant layer is comprised of a nylon material and may have a thickness and resistivity which varies depending upon the use of the bottle to which the label is applied. The resistant layer may be located, for example, at areas of maximum strain or exposure, such as around the leg portion and/or elongate strip.

The label with applied handle may further comprise a secondary peel-off label on the label, the peel-off label being die cut within the label so as to be removable therefrom. The label with applied handle may also comprise a booklet applied onto the upper surface of the label portion.

According to another aspect of the invention, there is provided a method of forming a label with hanging strip comprising: placing a label having an upper surface and a lower surface on a liner material, and securing the label to the liner by an adhesive layer on its lower surface, the adhesive layer being such that the label can be peeled off the liner with the adhesive remaining on the lower surface of the label; and affixing a handle having an elongate strip and a hanger portion to the upper surface of the label such that a lower surface of the elongate strip extends continuously across the entire length of the label, the lower surface of the elongate strip being firmly secured to the upper surface of the label by a strong bonding material, the hanger portion being integrally connected to the elongate strip and extending therefrom and having an upper surface and a lower surface with no adhesive thereon, the hanger portion being pivotable relative to the elongate strip so as to be movable between a first position wherein the hanger portion is adjacent the label portion, and a second position wherein the hanger portion is pivoted through substantially 180 degrees from the first position. The method may comprise cutting multiple series of scores to create a plurality of lines of weakness in the elongate strip.

BRIEF DESCRIPTION OF THE DRAWINGS

FIG. 8 is a perspective view of a fifth embodiment of a label of the invention including a peel-off label; and FIG. 9 is a bottom end view of the label shown in FIG. 8.

DETAILED DESCRIPTION OF THE PREFERRED EMBODIMENTS

Figure 1:
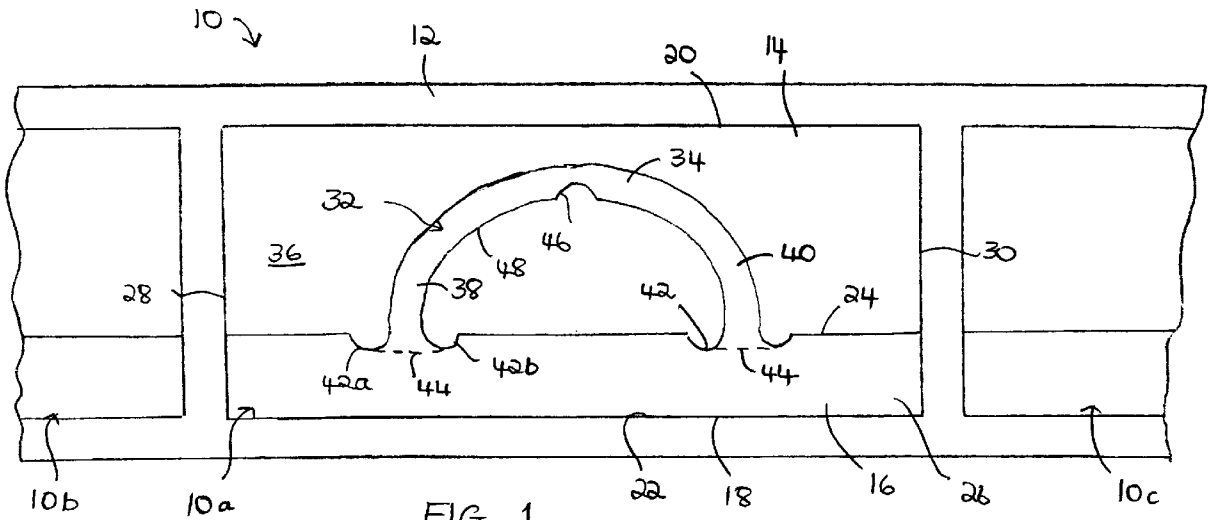
FIG. 1 is a top view of a first embodiment of a label of the invention.

Reference is now made to the accompanying drawings which show various forms and embodiments of a label of the invention. With particular reference to FIG. 1 of the drawings, there is shown a label with applied handle 10 of the invention. In a typical manufacturing procedure, a plurality of such labels with applied handle 10 will be arranged end-to-end and serially on a roll of paper liner 12, ready for removal thereof and subsequent application to a bottle. In FIG. 1, a full label with applied handle 10*a* is shown, and partial labels with applied handle 10*b* and 10*c* are indicated, illustrating the end-to-end serial relationship of the labels on the paper liner 12.

The paper liner 12 comprises a long narrow, continuous strip of paper for receiving the labels with applied handle 10, and may have a coated surface, or be comprised of a suitable material, so that the label with applied handle 10 can be easily peeled off without tearing or damage.

The label with applied handle 10*a* comprises a label portion 14 of substantially rectangular shape and a handle portion 16 superimposed on the label portion 14. The label portion 14 has a lower edge 18 and an upper edge 20, while the handle portion has a lower edge 22 and an upper edge 24. The lower edge 18 of the label portion 14, and the lower edge 22 of the handle portion 16, are substantially superimposed and aligned.

The handle portion 16 comprises an elongate strip 26 extending upwardly from the lower edge 22, and located between sides 28 and 30 of the label portion 14. The handle portion 16 has a hanger 32 which, in the embodiment shown in FIG. 1, includes a more or less semi-circular ring 34, and a pair lateral bands 38 and 40 extending downwardly therefrom towards the elongate strip 26.

Figure 3:
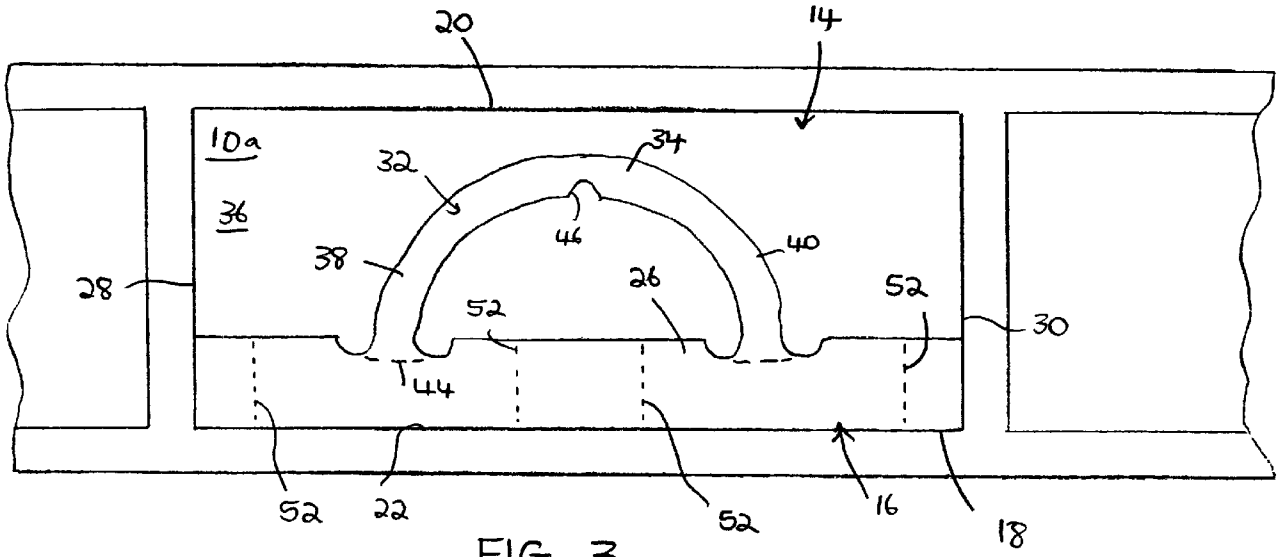
FIG. 3 shows a third embodiment of the label of the invention including a series of scores or cuts on the handle.

The elongate strip 26 is firmly bonded and adhered to an upper surface 36 of the label portion 14. To the extent that any adhesive may be present on the hanger 32 of the handle portion 16, such adhesive is either inactivated by deadening thereof, or by covering the adhesive with appropriate materials, such as a clear liner. In any event, the effect of the inactivation of the adhesive is that the hanger 32 is not bonded or attached to the upper surface 36 of the label portion 14, but can be readily moved towards and away from such surface 36. This can be clearly seen with reference to FIG. 3 of the drawings, where the hanger 32 can move, as will be described in further detail below, towards or away from the surface 36.

The hanger 32 consists of the semi-circular ring 34 with the two lateral bands 38 and 40 depending therefrom, and, in order to prevent tearing, and to provide considerable additional strength to the hanging load capability of the hanger 32, each lateral band 38 and 40 is connected to the elongate strip 26 through a pair of looped cuts 42. This an important structural feature which helps to prevent tearing of the handle portion 16 when in the load supporting mode.

In FIG. 1 and other figures of the drawings, the staggered line 44 represents the adhesive border. This adhesive border 44 is located near the very base of each of the lateral bands 38 and 40. On the lateral band 38 and 40 side of the adhesive border 44, any adhesive which is present has either been deadened or covered so as to render it ineffective, while adhesive on the elongate strip 26 side of the adhesive border will be fully functional and activated so as to hold the handle portion 16 in a very secure manner on the upper surface 36 of the label portion 14. The covered or inactivated portion comprising that portion of the hanger 32 above the adhesive border 44 can be moved freely towards and away from the label portion 14.

Figure 5:
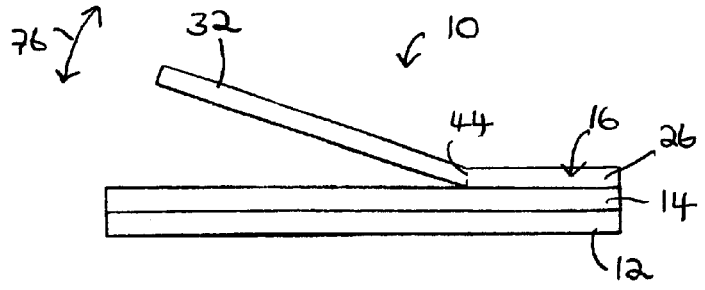
FIG. 5 is a side view of the label as shown in FIG. 1, illustrated diagrammatically, which clearly shows the handle portion with respect to the base label.

The looped cuts 42 are of a semi-circular shape, and there is one looped cut on each side of lateral bands 38 and 40. The adhesive border 44 on each of the lateral bands 38 and 40 is located such that this border 44 flows from each of a pair of looped cuts 42*a* and 42*b* thus providing a continuous fold line or pivot about which the hanger 32 may move towards or away from the label portion 14. As best illustrated in FIG. 5 of the drawings, the adhesive border 44 constitutes a pivot line and is positioned on the handle portion 16 so that there will be no exposed adhesive on that part of the hanger 32 which may interfere with the ability of the hanger 32 to fold in and out as it moves towards or away from the upper surface 36 of the label 14.

At approximately the apex of the semi-circular ring 34, there is located a notch 46 which comprises a small recess on the inner edge 48 of the hanger 32. When the label 10*a* is located on a bottle, and the hanger 32 turned so as to suspend the bottle in an inverted position, the notch 46 will be positioned such that it receives a peg or other form of bracket upon which the bottle is suspended. The notch 36 therefore assists in stabilizing the bottle upon which the label is mounted when in the inverted and suspended position. The location of the peg in the notch 46 also helps to keep the bottle "centered" while in the inverted suspended position by ensuring that the hanger 32 does not slide over the peg or bracket, causing the bottle to be angled or lopsided.

In manufacturing the label with applied handle 10 of the invention, the label portion 14 forms a discrete base portion mounted on the paper liner 12. Thereafter, the handle portion 16 is applied to the label portion 14 such that only the elongate strip 26 will adhere to the label portion 14. The continuous elongate strip 26, which preferably extends completely across the length of the label portion 14 from one side 28 all the way to the other side 30 thereof, has several important advantages. First, the existence of the elongate strip 26 extending all the way across the label portion 14 provides a substantial coverage area over which the elongate strip 36 may be adhered to the label portion 14. Therefore, if in use the weight of the bottle tends to loosen or separate the elongate strip 26 from the label portion 14, especially at the points of maximum pull at or near the adhesive border 44, it will require a substantial load for a prolonged time period for complete removal and/or separation of the elongate strip 26 to occur over the entire length of the label. The invention therefore permits easy application of a handle portion 16 to a base label without the need for die cutting through certain layers only, but at the same time offers rigidity, strength and a secure connection over a comparatively large area.

Another advantage of having the continuous elongate strip 26 over the entire length of the label portion 14 occurs in the manufacturing and production process. In this regard, the handle portion 16 can be applied onto the label portion 14, and the cut out of the hanger 32 as well as the cuts of the lower edge 22 of the handle and the sides thereof corresponding to sides 28 and 30, can be accurately and precisely made when cutting the label portion 14 itself. Thus, that process which cuts the upper edge 20, lower edge 18, sides 28 and 30 of the label 14 will also cut the sides and lower edge 22 of the handle in one operation. If the production process is such that the hanger 32 will also be cut, as will be described below, at the same time as the cutting of the label, this can also be achieved in the single operation.

Depending on the nature of the use of the label, as well as the dimensions and specifications of the bottle to which it will be applied, it may be advantageous to have on the handle portion 16, and particularly on the elongate strip 26, one or more scores 52 which consist of lines of weakness extending across the elongate strip in a direction substantially transverse thereto. The scores 52 preferably consist of a continuous cut or a series of cuts through a portion of the thickness of the elongate strip 26. Since the handle portion 16, and particularly the elongate strip, 36, is applied over and onto the label portion 14, there may be, to a small extent, some flagging or creasing of either the label portion 14 or the elongate strip 26 when the label with applied handle 10 is placed on a bottle. This may be due to the fact that the label with applied handle 10 is curved about the circumference of the bottle, such that the label portion 14 will have a slightly smaller radius of curvature than the elongate strip 26. The flagging or creasing of the label portion 14 or elongate strip 26 can, to a large extent be avoided, by the incorporation of these scores 52 which comprise lines of weakness and therefore provide the elongate strip 26 with the ability to stretch slightly to avoid the creasing or flagging.

The flagging or creasing effect may be more prevalent in smaller bottles having smaller diameters. The presence and number of the scores 52 may therefore depend upon the parameters of the label itself, as well as the bottle on which the label will be applied. It is, however, important to note that these scores 52 do not comprise complete cuts, but only staggered cuts or serrations, which do not result in a complete separation on the elongate strip. The scores 52 only permit the slight stretching of the elongate strip which may be necessary due to its different radius of curvature when placed on a bottle, as compared with that of the label portion 14. However, in order for the label with applied handles 10 to have its full strength and effect, it is important that the elongate strip 26 be continuous along its length in the sense that it is not completely severed or separated at any one point.

To provide the label with applied handle, or any part thereof, with additional strength, and to preserve the legibility of any information printed thereon, there may be located on the label a layer which is specifically designed to resist tears, nicks, scratches or other damage which may result from normal use of the label. The resistant layer may be comprised of a nylon material with a thickness and resistivity which varies depending upon the use of the bottle to which the label is applied. The resistant layer may be located, for example, at areas of maximum strain or exposure, such as around the leg portion and/or elongate strip. In one embodiment, the resistant layer covers the entire base label and is affixed thereto prior to the application of the handle portion, and any peel off labels which are located on the base label. The handle may also incorporate the resistant layer, to enhance its weight bearing capabilities and to minimize any stretching of cuts thereon which would compromise its strength.

The label with applied handle 10 may also include one or more peel-off labels 60. As shown in the label in FIG. 2 of the drawings, three peel-off labels 60*a*, 60*b*, and 60*c* are provided. Each peel-off label may include identifying information printed thereon to associate it with a particular patient, bottle or other source, and can be written on, removed, and thereafter applied to, for example, a patient's chart or other medical records.

The peel-off label may be formed on the label portion 14 in one of several ways. In one embodiment, each one or all of the peel-off labels 60 may comprise a portion of the label portion 14, and the peel-off label may be defined by a die-cut 62. The die-cut 62 would extend at least a portion of the way through the label portion 14, and a release coating or deadening layer, may be applied on the underside or the peel-off label 60 in order to make it easily separable from the remainder of the label portion 14.

In another form, the peel-off label 60 may comprise an applied label, which is placed on to the label portion 14, in a similar manner in which the handle portion 16 is placed on another part of the label portion 14. In this embodiment, discussed further below with reference to FIG. 7, the peel-off label has an upper surface 64 and a lower surface 66 placed on a suitable portion of the label 14. The lower surface 66 of the peel-off label 60 would have an adhesive which would enable it, when removed, to be applied to another source, such as a patient's chart or other medical records. However, the adhesive would be of such a nature so as to permit the peel-off label to be removed from the label portion 14 without disintegrating or tearing.

In yet a further variation, the peel-off label 60 may comprise the entire thickness of the label portion 14, including die-cuts 62 to enable it to be separated therefrom. In such an arrangement, the lower surface 66 of the peel-off label 60 is appropriately treated to have adhesive properties, but also allow it to be removed from the liner 12 and/or bottle on which it is mounted without tearing or disintegration.

Figure 2:
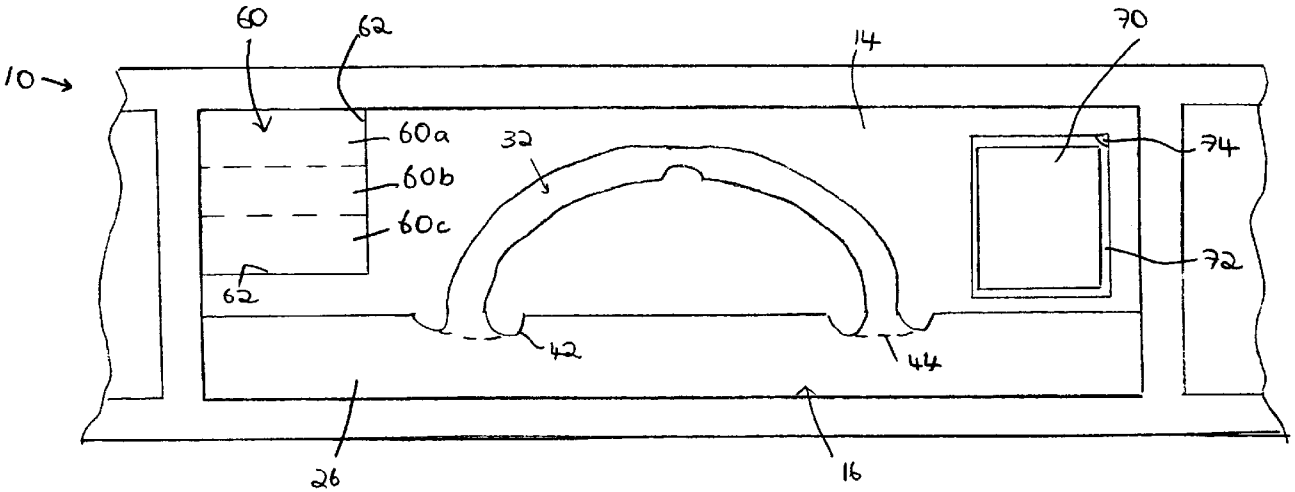
FIG. 2 is a top view of a second embodiment of a label of the invention including a peel off label and booklet.

As is seen in FIG. 2 of the drawings, the label portion may also form a base for the application of a booklet or outsert 70. In one form, the booklet or outsert may comprise a stitched booklet or long paper strip with printed medical or other information, which has been folded in such a way that it can be removed, opened and read. The booklet 70 may be attached to the label portion 14 in a number of ways. For example, the folded booklet may, during label production, be mounted at the desired location on the label portion 14 and a transparent or other covering 72 placed over it. Such covering 72 may be clear mylar with an adhesive layer on its lower surface, whereby this adhesive layer is secured to the upper surface 36 of the label portion 14. The adhesive properties of the adhesive layer on the lower surface of the covering 72 permit appropriate mounting and holding of the booklet on the label portion, but can also be relatively easily peeled away from the surface of the label portion so as to provide access to the booklet 70. The covering 72 may include a tag 74 which can be easily grasped initially to remove the covering 72 from the booklet.

The handle portion 16, comprising the elongate strip 26 and the hanger, is preferably of a transparent material, permitting substantially the entire upper surface 36 of the label portion 14 to be used for printed, tabulated, or other identifying information. Such information is printed on the label portion 14 prior to the bonding thereon of the handle portion 16. Since the handle portion 16 is transparent, the printed information will always be legible, irrespective of whether or not the hanger 32 is in use in the unfolded, or in the folded position prior to such use. Furthermore, the active or inactive position of the hanger 32, namely, when suspending a bottle, or when applied flat against the label portion, will not in any way damage, efface or otherwise remove any printed material on the label portion 14.

The application of the transparent handle portion 16 to the label portion 14 after information has been printed on the label portion 14 also ensures that the label can be easily copied, and the arrangement of the information can be presented on the label without regard to the position of the hanger 32.

Figure 4:
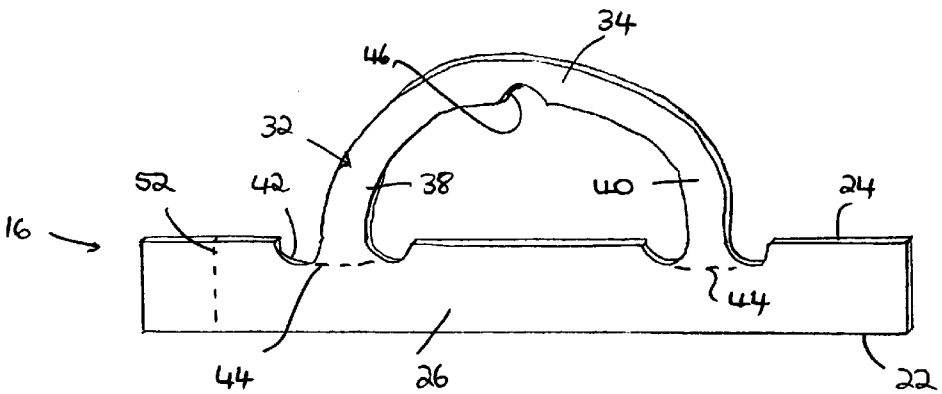
FIG. 4 is a perspective view of the handle only of the invention, the thickness of the handle being somewhat exaggerated.

Reference is now made to FIG. 4 of the drawings which shows a plan view of the handle portion 16 before its application to the label portion 14. This figure also shows a plan view of the handle portion if it were to be removed from the label portion, or if the handle portion were to be cut to its particular shape after an upper layer had been applied to the label portion 14. While the handle portion 16 shown in FIG. 4 is, in all material respects, identical to that shown in FIG. 1, FIG. 4 is intended to emphasize the exact shape and independent nature of the handle portion 16. It is an essentially separate element from the label portion 14 which is bonded to the label portion 14. It is not an integral part thereof or cut from various layers of the label portion 14.

FIG. 4 also highlights the continuous nature of the elongate strip 26, and its relatively large surface area which is bonded to the upper surface 36 of the label portion 14. This helps to ensure the continued and firm attachment of the handle portion 16. Thus, should the weight of the bottle, over time, cause a slight separation of a part of the handle portion 16 from the label portion 14, particularly near the adhesive border 44 and about the looped cuts 42, the elongate strip 26 remains connected over the remaining substantial surface area to ensure that the handle portion 16 does not separate from the label portion 14. Further, since the elongate strip 26 will, in use, be mounted on a bottle and curve around the bottle, any loosening or separation that may occur will to at least some extent be prevented as a result of the tautness in the elongate strip 26 due its curved position.

FIG. 5 of the drawings shows a diagrammatic side view of the label with applied handle 10 shown in FIG. 1. The bottom layer is the paper liner 12, upon which the label portion 14 is located, and to which it is connected by an adhesive. The adhesive and paper liner 12 are selected for the ability of the label portion 14 to be easily peeled off and removed from the paper liner 12 when the label with applied handle 10 is required. Above the label portion 14, there is located the handle portion 16 which comprises the elongate strip 26 and the hanger 32. The adhesive border 44 essentially demarcates the elongate strip 26 from the hanger 32. The elongate strip 26 is firmly bonded and adhered to the label portion 14 below. However, the hanger 32 has no such adhesive, and can be moved towards or away from the label portion 14 in the direction of the arrow identified by the numeral 76. In this way, it can be seen that the hanger 32 essentially pivots about the adhesive border 44, and is capable of movement between one extreme position when the hanger 32 rests directly against the label portion 14, and the other extreme position at approximately 180 degrees where the hanger 32 is folded over the elongate strip 26, and is thus in its active position for suspending an inverted bottle.

Figure 6:
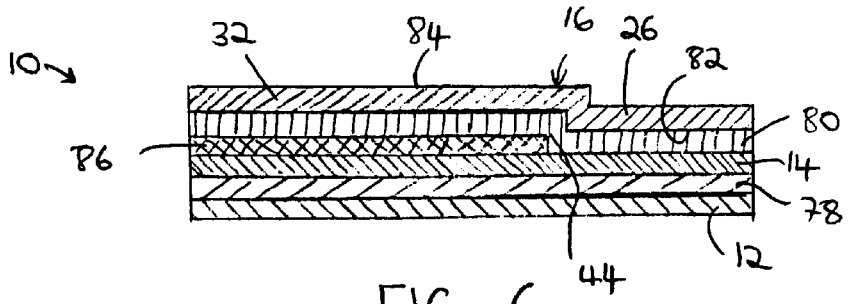
FIG. 6 is a diagrammatic side section through the label shown in FIG. 1 showing in greater detail the various layers which comprise the label.

Reference is now made to FIG. 6 of the drawings which shows a more detailed schematic view, in cross section, of the various layers which constitute the label with applied handle 10. Several of the layers have already been described and identified above, particularly with reference to FIG. 5. Thus, the base constitutes the paper liner 12. Above the paper liner 12 is the label portion 14, or face stock, which is attached to the paper liner 12 by an adhesive layer 78. The adhesive layer 78 is such that, upon removal of the label portion 14 from the liner 12, the adhesive layer 78 remains part of the lower surface of the label portion 14, thereby providing an adhesive layer for firm attachment of the label portion 14 to a bottle.

The handle portion 16 in FIG. 6 has an adhesive layer 80 applied consistently and completely to its lower surface 82. The upper surface 84 of the handle portion 16 has no adhesive. In FIG. 6, the hanger 32 and elongate strip 26 of the handle portion 16 are shown, as is the adhesive border 44. In this particular embodiment, the effect of the adhesive layer 80 is rendered inactive by the application of a clear liner 86 to that portion of the adhesive layer 80 applied to the hanger 32. The effect is that the hanger 32 can freely move away from the label portion 14 without restriction. Further, the hanger 32, when suspended over a peg or bracket, will not stick to the peg or bracket.

In other embodiments, different processes may be used to inactivate the adhesive layer 80 below the hanger 32. Such inactivation may comprise a complete removal of the adhesive layer 80 beneath the hanger 32. Alternatively, this portion of the adhesive layer 80 may be inactivated, instead of by a clear liner, by a resin-deadening agent, or other chemical composition which will eliminate the adhesive properties of this adhesive layer 80.

In use, a label with applied handle 10*a* is peeled off the paper liner. The label is preferably dimensioned such that the distance between the adhesive borders 44 on the lateral bands 38 and 40 is approximately equal to the diameter of the bottle. The label with applied handle 10*a*, when removed from the paper liner 12, is applied to the bottle such that the lower edge 18 of the label portion in close proximity to the base of the bottle, while the upper edge 20 of the label portion is close to the neck or open end of the bottle. The label portion 14, which has an adhesive layer 76 on its back surface, adheres to the bottle firmly. The label portion 14 includes securely bound thereto the elongate strip 26 and the hanger 32. When the bottle is required to be suspended in an inverted position, the hanger 32 is pulled away from the label portion 14, and pivoted about the adhesive border lines 44 through approximately 180 degrees. In this position, the hanger 32 will essentially straddle the bottle, with each lateral band 38 and 40 being approximately diametrically opposed to each other, and the semi-circular ring 34 defining an arcuate semi-circle around the base of the bottle. In this position, the bottle is easily suspended while in an inverted position over a peg, bracket or the like. To facilitate the centering, alignment and stabilization of the bottle while suspended from a hanger 32, the notch 46 will receive the peg or bracket and help to reduce or prevent sliding of the hanger 32 with respect to the peg.

Figure 7:
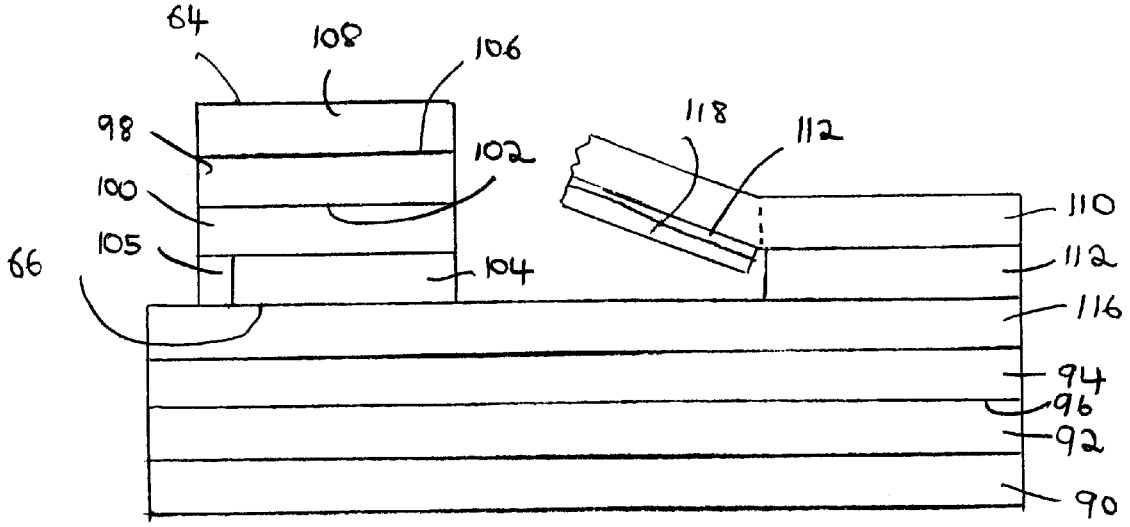
FIG. 7 is a diagrammatic side section showing the various layers in fourth embodiment of the label of the invention including a peel off label.

Reference is now made to FIG. 7 of the drawings which shows a diagrammatic section view through a further embodiment of the invention. FIG. 7 shows the various layers which comprise the invention, including a liner 90 which forms the base of the label. A label portion 94 having an adhesive layer 92 on its lower surface 96 is located on the liner 90, and when the label 94 is peeled off the liner 90, the adhesive layer 92 will be removed with it, providing an adhesive by means of which the label may be applied to the surface of a bottle. In this embodiment, the label 94 is made of clear Mylar. A peel off label 98 having an adhesive layer 100 on its lower surface 102 is located over the clear mylar label 94. The adhesive layer 100 is partially inactivated by the application of a release coat 104 which allows the base label to be easily separated from the clear mylar label 94. A small area is covered with a deadening agent 105 to provide initial access. The base label 98 has on its upper surface 106 a layer of printed matter 108 upon which medical or other information is placed. A hang label 110 is located over a printed layer 116 with a hang label adhesive 112 there between. In this embodiment, a clear liner layer 118 is affixed to the lower surface of the hang label adhesive 112 to deactivate or render inoperable the adhesive properties of the hang label adhesive layer 112. This enables the hang label to be removed easily towards or away from the base label 98.

Reference is now made to FIGS. 8 and 9 of the drawings which show a fifth embodiment of a label, designated as reference numeral 150. The label 150 is located on a liner 152 from which it may be removed when required. The label 150 comprises a label base 154 of substantially rectangular shape, and a handle portion 156 superimposed on the base label 154. The label base 154 has a lower edge 158, and upper edge 160 and side edges 162 and 164 respectively.

The handle portion 156 is adhesively secured to the upper surface 166 of the label base 154 such that the lower edge 168 of the handle portion lies over, or corresponds with, the lower edge 158 of the label base 154. One side edge 170 of the handle portion 156 corresponds with the side edge 164 of the label base 154. The handle portion 156 comprises an elongate strip 172 and a hanger 174. The usual looped cut-outs 176 form part of the handle portion 156. Other than described below, the handle portion 156 has the same structure and components as that described with respect to the previous embodiments, and these details will not be repeated.

On one side of the label base 154, and mounted on the upper surface 166 thereof, there is a removable or peel-off label 178, and, on the inside thereof, a permanently located label 180. The lower edges 182 and 184 of the peel-off label 178 and permanent label 180 respectively correspond with the lower edge 158 of the label base 154. The side edge 186 (clearly seen in FIG. 9) of the peel-off label 178 corresponds with the side edge 162 of the base label 154. The upper edge 188 of the permanent label 180 is flush with the upper edge 160 of the base label. However, the peel-off label 178 extends a short distance beyond the upper edge 160, providing a tab 198 for easy access to remove the peel-off label 178, as will be described in further detail below.

The elongate strip 172 steps up and over a portion of the permanent label 180 to form a step portion 190. This step portion 190 stops short of the peel-off label 178, which is not covered thereby.

Both the peel-off label 178 and the permanent label 180 are superimposed on or cover the upper surface 166 of the label base 154. The permanent label 180 includes on its lowest surface an adhesive 192 by means of which it is firmly and permanently fixed to the upper surface 166 of the label base 154. The peel-off label 178 also has an adhesive layer 194 but further comprises a release coat 196 which allows the peel-off label 178 to remain adhered to the upper surface 166, but also allows it to be peeled off fairly readily. The tab 198 at the upper end of the peel-off label 178 has its adhesive inactivated by an adhesive deadener and, when lifted, the entire strip of the peel-off label 178 can be removed from the upper surface 166 of the label base 154.

With reference to FIG. 9, there is also shown the adhesive layer 200 by means of which the label base 154 is attached to the liner 152. The adhesive layer 200 is appropriately treated so that the label adheres to the liner 152, but can be fairly easily peel off therefrom. FIG. 9 also shows the adhesive layer 202 by means of which the elongate strip 172 is applied to the upper surface 166 of the label base 154. This adhesive layer is a strong one to ensure a permanent bond between the elongate strip 172 and the label base 154. The adhesive layer 202 extends beneath the elongate strip 172 along its entire length, including that of the step portion 190.

One advantage of the embodiment shown in FIGS. 8 and 9 is that the elongate strip 172 of the handle portion 156 is directly adhered to the label base 154, without any intermediate layer, which may typically be used for printing. It is possible that such additional layers may compromise the strength of the bond between the elongate strip 172 and the upper surface 166. Therefore, in the embodiment of FIGS. 8 and 9, an enhanced bonding strength between the elongate strip 172 and the base label 154 can be achieved. At the same time, the peel-off label 178 and permanent label 180 are provided so as to give the label 150 the desirable features which the circumstances require. Thus, information can be written on the permanent label 180, such as lot number and expiry date, and similar information can be recorded on the removable peel-off label 178. The peel-off label 178 is removed and placed on, for example, a patient's chart or file so that the necessary records can be kept associating the contents of the bottle on which the label is applied with the particular patient.

In the embodiment shown in FIGS. 8 and 9, the label 150 may be manufactured by first providing a layer of face stock of any suitable material over an appropriate liner. Thereafter, a layer of printed paper is located over the face stock at one end thereof and the appropriate printed information placed on the face stock. Excess or additional printed paper is removed so that only the permanent and peel-off label sections 178 and 180 remain. Thereafter, the handle is laid down on the upper surface of the label base 154 and part of the permanent label 180 as shown with respect to FIGS. 8 and 9.

The peel-off label, in one embodiment, is die-cut from the label so as to provide a plurality of joins or tags therebetween, the joins being easily torn by removal of the peel-off label.

The label with applied handle of the invention can be manufactured according to various processes. For example, the label portion 14 is placed on the liner 12 as a first step,.and appropriate die cut may be made if additional peel-off labels are integrated into, or placed on the label portion. Thereafter, the handle portion 16 is located on the label portion 14. The handle portion 16 may be cut and formed with the elongate strip 26 and hanger 32 prior to its application to the label portion. In its preformed condition, the handle portion is located over the label portion such that the elongate strip corresponds with the lower edge 18 of the label, and a strong adhesive is used to bond the elongate strip to the upper surface 36 of the label portion 14.

In another embodiment, the handle portion can be located on the label portion as an uncut layer and thereafter processed through die cutting to form the hanger portion. Thus, the unformed hanger portion may comprise the elongate strip with the adhesive, and a solid portion completely covering the remainder of the label thereabove, including a liner to deactivate the adhesive and prevent it from becoming bonded to the label portion. Thereafter, the hanger 32 can be cut and the remaining portions around the hanger 32 removed.

In yet another arrangement, the handle portion 16 can be located over the label portion 14 in the same manner as immediately described above, but without the adhesive covered by a liner or completely deactivated. The adhesive on the handle portion other than on the elongate strip, where strong bonding to the label portion will take place, may have a partially deadened, or less effective adhesive. The hanger 32 is then cut, and the lower surface of the hanger upon which any adhesive may be located is either covered with a liner or treated so as to deaden or inactivate the adhesive. This will permit the hanger 32 to move towards or away from the label portion. The remainder of the handle portion 16, not forming part of the hanger 32, can either remain on the label, giving it additional strength in rigidity, or it can simply be removed.

What is claimed is:

1. A label with applied handle comprising:

a liner;

a label having an upper and lower surface located on the liner, the label being secured to the liner by an adhesive layer on its lower surface, the adhesive layer being such that the label can be peeled off the liner with the adhesive remaining on the lower surface of the label;

a handle affixed to the upper surface of the label, the handle comprising an elongate strip having an upper and a lower surface and extending continuously and completely across an entire length of the label, the lower surface of the elongate strip being firmly secured to the upper surface of the label by a strong bonding material, and a hanger portion integrally connected to the elongate strip and extending therefrom, the hanger portion having an upper surface and a lower surface with no adhesive thereon, the hanger portion being pivotable relative to the elongate strip so as to be movable between a first position wherein the hanger is adjacent the label and a second position wherein the hanger portion is pivoted through substantially 180 degrees from the first position, wherein the elongate strip has a length and a width and comprises at least one score to form a line of weakness along at least a part of its width.

2. A label with applied handle as claimed in claim 1 wherein multiple lines of weakness are provided along the elongate strip, each line of weakness being substantially transverse to the length of the elongate strip.

3. A label with applied handle as claimed in claim 2 wherein at least one line of weakness is located near each end of the elongate strip.

4. A label with applied handle as claimed in claim 1 wherein the hanger portion comprises a semi-circular ring portion and a pair of depending leg portions, each leg portion having one end thereof connected to the elongate strip.

5. A label with applied handle as claimed in claim 4 further comprising an adhesive border at a transition between the elongate strip and the leg portion, the adhesive border having on one side thereof an adhesive whereby the elongate strip is applied to the label, and on an opposite side thereof an absence of adhesive, the adhesive border providing a pivot about which the hanger portion moves between the first and second position.

6. A label with applied handle as claimed in claim 4 further comprising a notched recess on an inside edge of the semi-circular ring, portion the notched recess being substantially centered along the semi-circular ring portion.

7. A label with applied handle as claimed in claim 5 comprising a pair of looped cuts in the elongate strip adjacent the adhesive border, the looped cuts comprising substantially semi-circular cuts having continuous lines with edges of the hanger portion.

8. A label with applied handle as claimed in claim 7 wherein the adhesive border is positioned so as to form a continuous arcuate line between the looped cuts.

9. A label with applied handle as claimed in claim 1 further comprising a secondary peel-off label on the label, the peel-off label being die cut within the label so as to be removable therefrom.

10. A label with applied handle as claimed in claim 9 wherein the peel-off label is die cut from the label so as to provide a plurality of joins or tags therebetween, the joins being easily torn by removal of the peel-off label.

11. A label with applied handle as claimed in claim 1 further comprising a peel-off label applied onto the upper surface of the label, the peel-off label having a lower surface with an adhesive layer thereon, the peel-off label being removable from the upper surface of the label with its adhesive layer.

12. A label with applied handle as claimed in claim 1 further comprising a booklet applied onto the upper surface of the label.

13. A label with applied handle as claimed in claim 12 wherein the booklet is applied by means of a liner cover, the liner cover having a lower surface with adhesive and being of dimensions slightly greater than the booklet so as to extend beyond edges of the booklet and secure the booklet to the upper surface of the label.

14. A label with applied handle as claimed in claim 13 wherein the liner incorporates a tag to facilitate removal thereof from the label.

15. A label with applied handle as claimed in claim 1 further comprising a resistant layer located on at least a part thereof to impart increased strength and protection to the label with applied handle.

16. A label with applied handle comprising:

a rectangular label having an upper edge, a lower edge and two side edges, the label having a lower surface having adhesive thereon, and an upper surface;

a handle, a portion of which is securely fixed to the upper surface of the label, the handle having an elongate strip extending continuously between the two side edges of the label, the elongate strip having a lower edge corresponding to the lower edge of the label, and two side edges corresponding to the side edges of the label, the elongate strip further having an upper edge, the handle including a hanger extending upwardly from the upper edge of the elongate strip and having upper and lower surfaces with no adhesive thereon, the hanger being located over the label and being movable between a first position where the hanger covers the label, and a second position substantially 180° therefrom, and wherein the elongate strip has a length and a width and comprises at least one score to form a line of weakness alone at least a part of its width.

17. A label with applied handle as claimed in claim 16 further comprising an adhesive border on the handle located between the elongate strip and the hanger, the adhesive border providing a pivot point about which the hanger can move between the first position and the second position.

18. A method of forming a label with a hanging strip comprising:

placing a label having side edges, an upper surface and a lower surface on a liner, and securing the label to the liner by an adhesive layer on its lower surface, the adhesive layer being such that the label can be peeled off the liner with the adhesive remaining on the lower surface of the label;

affixing a handle having an elongate strip which has a length and a width and a hanger portion to the upper surface of the label such that a lower surface of the elongate strip extends continuously and completely between the side edges of the label, the lower surface of the elongate strip being firmly secured to the upper surface of the label by a strong bonding material, the hanger portion being integrally connected to the elongate strip and extending therefrom and having an upper surface and a lower surface with no adhesive thereon, the hanger portion being pivotable relative to the elongate strip so as to be movable between a first position wherein the hanger portion is adjacent the label portion, and a second position wherein the hanger portion is pivoted through substantially 180 degrees from the first portion; and forming at least one score as a line of weakness along at least a part of the width of the elongate strip.

19. A method as claimed in claim 18 further comprising cutting a series of scores in the elongate strip to create a line of weakness to enable the elongate strip to stretch slightly with respect to the label.

20. A method as claimed in claim 18 wherein the label is formed into a rectangular shape and has an upper edge, a lower edge and two side edges, and the elongate strip has a lower edge and two side edges which are located on the label so as to align substantially with the lower edge and side edges respectively of the label, the elongate strip covering about one third of the label and the hangar being positioned over the remaining two thirds of the label.

21. A label with applied handle comprising:

a label having side edges, an upper and lower surface and an adhesive layer on the lower surface thereof;

a handle affixed to the upper surface of the label, the handle comprising an elongate strip having a length and a width and an upper and lower surface extending between the side edges of the label, the lower surface of the elongate strip firmly secured to the upper surface of the label by a bonding material, the elongate strip further having at least one score to form a line of weakness along at least a part of its width, and a hanger portion integrally connected to the elongate strip and extending therefrom, the hanger portion having an upper surface and a lower surface with no adhesive thereon, the hanger portion being pivotable relative to the elongate strip so as to be movable between a first position wherein the hanger portion is adjacent the label portion, and a second position wherein the hanger portion is pivoted through substantially 180 degrees from the first position;

a removable label mounted on one side of the label, the removable label being located on the upper surface of the label and being adhered thereto such that the removable label can be easily removed from the upper surface of the label; and a permanent label mounted on the label, the elongate strip of the handle extending over the permanent label and not covering the removable label.

22. A label with applied handle as claimed in claim 21 wherein the hanger comprises a semi-circular ring portion and a pair of depending legs, each leg portion having one end thereof connected to the elongate strip.

23. A label with applied handle as claimed in claim 22 further comprising a notched recess on an inside edge of the semi-circular ring portion, the notched recess being substantially centered along the semi-circular ring portion.

24. A label with applied handle as claimed in claim 21 wherein the removable label and permanent label are adjacent each other, the removable label having one edge thereof which registers with an edge of the label, the permanent label having an edge which is adjacent an inside edge of the removable label.

* * * * *